United States Patent [19]

Hotta et al.

[11] Patent Number: 4,600,287

[45] Date of Patent: Jul. 15, 1986

[54] METHOD AND DEVICE FOR AUTOMATICALLY DEVELOPING PHOTOSENSITIVE MATERIAL

[75] Inventors: Tomiji Hotta; Masami Ohtani, both of Kyoto; Yoshihiro Masuda, Shiga; Norimasa Nomura; Yozi Dohi, both of Kyoto, all of Japan

[73] Assignee: Dainippon Screen Seizo Kabushiki Kaisha, Kyoto, Japan

[21] Appl. No.: 504,579

[22] Filed: Jun. 15, 1983

[30] Foreign Application Priority Data

Jul. 30, 1982 [JP] Japan ..... 57-133302
Mar. 29, 1983 [JP] Japan ..... 58-51592

[51] Int. Cl.[4] ..... G03D 3/08
[52] U.S. Cl. ..... 354/299; 354/320
[58] Field of Search ..... 354/299, 319, 320, 321, 354/322; 430/348, 355

[56] References Cited

U.S. PATENT DOCUMENTS 4,081,211 3/1978 Shigeta et al. ..... 354/299
4,153,363 5/1979 Albano ..... 354/299
4,240,737 12/1980 Lawson ..... 354/299

OTHER PUBLICATIONS

John, D. H. O. et al., *Photographic Chemistry,* Reinhold Publishing Corporation, N.Y. 1963, "Temperature", pp. 118–121.

Pittaro, Ernest, *Photo-Lab-Index Lifetime Edition,* Morgan and Morgan, Inc. N.Y. 1976, pp. EK-3-94 and EK-3-95.

*Primary Examiner*—A. A. Mathews
*Attorney, Agent, or Firm*—Hayes, Davis & Soloway

[57] ABSTRACT

Disclosed are method and device for automatically controlling the time period of photographic development for each specific combination of a photographic developer and a photosensitive material for the purpose of obtaining a substantially same or optimum photographic development result at various temperatures. Through utilization of the knowledge of a certain relation between the time period of photographic development and the temperature of the photographic developer which will produce a same photographic development result, the time period of photographic development is adjusted, for instance, by changing the speed of a conveyor carrying the photosensitive material through the photographic developer. The mentioned relationship may not be always expressed by a linear function with a desired accuracy but may be approximated with a desired accuracy by means of various mathematical functions such as polynomials and irrational functions.

7 Claims, 2 Drawing Figures

METHOD AND DEVICE FOR AUTOMATICALLY DEVELOPING PHOTOSENSITIVE MATERIAL

Figure 1:
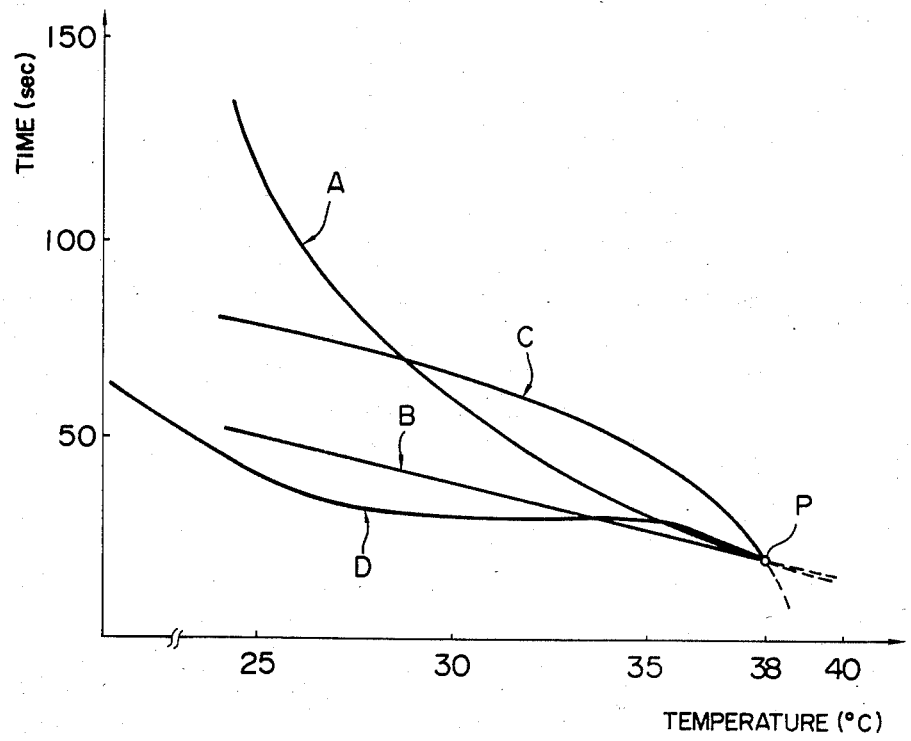

This invention relates to a method for automatically developing photosensitive material such as photographic film so as to produce a same photographic development result even when there is some fluctuation in the temperature of the developer and a device for carrying out such a method.

Generally, the result of photographic development are dependent on two factors; one is the temperature of the photographic developer that is used and the time period of photographic development or the time period during which the photosensitive material is exposed to the photographic developer.

In any photographic developing machine, a temperature regulator of one kind or another is utilized for regulating the temperature of the photographic developer. However, even with a highly sophisticated temperature regulator, it is unavoidable to experience some fluctuation in the temperature. Particularly, when the work for the day is about to start, it takes a substantial time for raising the temperature of the developer to a level which is within the range of the temperature regulation. It means a substantial time loss which is desired to be avoided particularly in view of the strong desire for a high work efficiency of a highly expensive automatic developing machine.

At any event, to the end of obtaining a substantially same photographic development result at all times, it is necessary to control the time period of photographic development in accordance with the changes in the temperature of the photographic developer. Generally, the higher the temperature, the shorter the time period of photographic development should be, and vice versa.

Conventionally, in the efforts to obtain uniform results of photographic development, a considerable attention was directed at keeping the temperature of the photographic developer as even as possible and it was common to spend a considerable warm up time at the beginning of each work period.

The present invention is based on the recognition that there is a certain relationship between the temperature of the photographic developer and the time period required for photographic development to obtain a substantially same development result and that, if the time period of photographic development is controlled in addition to the temperature of the photographic developer, a considerable improvement may be made in the work of photographic development for instance by reducing the waiting time period to a considerable extent.

In view of the above mentioned shortcomings of conventional methods and devices for automatically developing photosensitive material and based on the abovementioned recognition, a primary object of this invention is to provide a method and a device for automatically developing a photosensitive material which is capable of producing a substantially same photographic development result even when there is a substantial fluctuation in the temperature of the photographic developer.

Another object of this invention is to provide a method and a device for automatically developing photosensitive material which is free from a long waiting time before the temperature of the photographic developer is raised to a permissible temperature range.

According to the present invention, such objects are accomplished by providing a method for automatically developing photosensitive material, characterized by the steps of, deriving a mathematical function which approximately represents a relationship existing between the temperature of photographic developer and the time period of photographic development which will produce a substantially same photographic development result in regards to a specific combination of the photographic developer and the photosensitive material, adjusting the temperature of the photographic developer to a certain reference temperature, and controlling the time period of photographic development according to the actual temperature of the photographic developer;

and a device for automatically developing photosensitive material, comprising, a developing tank having a temperature sensor and a developer heater/cooler therein, a computing means which computes the time period of photographic development for obtaining a certain development result in relation with a signal supplied from the temperature sensor according to a certain mathematical function, a means for setting up the parameters for the mathematical function of the computing means, a means for controlling the time period of photographic development, and a temperature regulating means which activates the heater/cooler according to the signal from the temperature sensor so as to regulate the temperature of the developer to a certain reference temperature.

Figure 2:
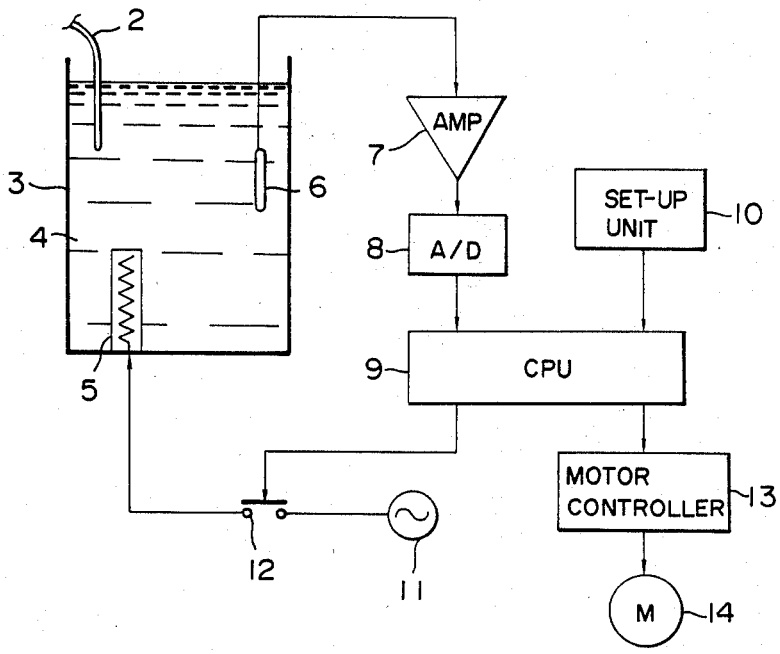

Now this invention is described in the following in terms of specific embodiments with reference to the appended drawings, in which:

FIG. 1 is a graph showing the relationships existing between the time period of photographic development and the temperature of the photographic developer which will produce a same photographic development result in regards to various combinations of photographic developers and photosensitive materials; and FIG. 2 is a block diagram of the device of this invention.

Now this invention is described in the following with reference to the appended drawings.

FIG. 1 shows the relationships existing between the temperature X of the developer and the time period Y of photographic development which will produce an identical photographic development result with respect to four different combinations of a photographic film and a photographic developer by means of experiments with a reference condition set at the temperature of 38° C. and the time period of 20 seconds and indicated by P in the graphs. The mathematical functions existing between X and Y for various combinations of a film, a photographic developer and a photographic developing device are as summarized in the following:

(Curve A) Film: LO-100-E made by Konishiroku Shashin Kogyo KK

Developer: CDM-621 made by Konishiroku Shashin Kogyo KK

Developing Device: LD-265-DQ made by Dainippon Screen Seizo KK

Function:

$$Y=aX^3+bX^2+cX+d \quad \text{(I)}$$

where $a=-1,749\times10^{-2}$ $b=2.179$ $c=-9.209\times10$ $d=1.340\times10^{2}$ (Curve B) Film: CBC-4 made by E. I. duPont de Nemours & Co.

Developer: C42D made by E. I. duPont de Nemours & Co.

Developing Device: LD-265-DQ made by Dainippon Screen Seizo KK

Function:

$$Y=aX+b \quad \text{(II)}$$

where $a=-2.030$ $b=9.714\times10$ (Curve C) Film: LO-100 made by Fuji Shashin Film KK Developer: LD-835 made by Fuji Shashin Film KK Developing Device: LD-265-DQ made by Dainippon Screen Seizo KK Function:

$$Y=a\,(b-X)^{\frac{1}{2}} \quad \text{(III)}$$

where $a=2.150\times10$ $b=3.890\times10$ (Curve D) Film: LS-500 made by Fuji Shashin Film KK Developer: LD-835 made by Fuji Shashin Film KK Developing Device: LD-265-DQ made by Dainippon Screen seizo KK Function:

$$Y=aX^4+bX^3+cX^2+dX+c \quad \text{(IV)}$$

where $a=-1.26\times10^{-3}$ $b=1.56\times10^{-2}$ $c=1.69\times10$ $d=4.71\times10^{2}$ $e=4.18\times10^{3}$ FIG. 2 is a block diagram showing an essential part of this invention. The following description refers only to a photographic film and a developer of the type which may be represented by Equation (I), but nothing is changed even in regard with the films and the developers which may be represented by Equation (II), (III) and (IV) and other functions.

In this drawing, numeral 2 denotes a film, numeral 3 a developing tank and numeral 4 a developer, and a temperature sensor 6 such as a thermistor and an electric heater 5 are provided in the developing tank 6.

The analog signal produced from the temperature sensor 6, after passing through an amplifier 7, is converted into a digital signal by an A/D converter 8 and is supplied to a central processing unit (which is referred to merely as "CPU" hereinafter).

Also supplied to the CPU 9 are the values of a, b and c as well as Equation (I) and the control temperature $x_0$ corresponding to the developer, by way of a set-up unit 10.

When the temperature x detected by the temperature sensor 6 is lower than $x_0$, the CPU 9 closes a switch 12 that is connected between the heater 6 and a power source 11 so as to control the rotational speed of a motor 14 continuously by way of a motor control circuit 13 as well as to heat up the developer 4 so that the film 2 is conveyed for photographic development at a speed corresponding to y computed from Equation (I).

As the temperature x of the developer rises, the rotational speed of the motor 14 gradually increases and, when the temperature x of the developer reaches the control temperature $x_0$, the switch 12 is opened so as to terminate the heating of the developer 4 and to keep the rotational speed of the motor 14 at a constant value so that the film 2 may be photographically developed for the control time period $y_0$.

Thereafter, the above described action is repeated over a small temperature range and the film 2 is photographically developed substantially at the control temperature $x_0$ and for the control time period $y_0$.

The above description referred only to the case in which the temperature x of the developer is lower than the control temperature $x_0$, but, when x is greater than $x_0$ and the developer has to be cooled down with a cooler, it is also possible to obtain a good development result by controlling the conveying speed of the film in a similar manner.

The following describes a manner of deriving the coefficients of a mathematical function, taking an example in a quadratic function, by which the relationship holding between the temperature of a photographic developer and the time period of photographic development for a same photographic development result may be approximated.

Set the upper limit of the temperature of the photographic developer and the corresponding time period of photographic development at the control temperature $x_0$ and the control time period $y_0$, respectively, which are normally specified by the manufacturer of the photosensitive material.

And, set the lower limit of the temperature $x_1$ at 40° C. $y_1$ is the time period of photographic development required for obtaining the same photographic result at this temperature.

If the relationship between the temperature of the photographic developer and the time period of photographic development required for obtaining the same photographic result is known over this temperature range, the desired quadratic equation may be readily obtained by mathematical procedures which are well known in the art.

On the other hand, if only the control temperature and the control time period are given and no other information is available, the desired quadratic function must be derived through an experimental process.

Specifically, the time period $y_1$ at the temperature $x_1$ is first derived experimentally and parameters m and n in a quadratic function $$y=m(x-x_1)^2+n(x-x_1)+y_1 \quad \text{(V)}$$

are obtained in the following manner so that the quadratic equation can produce the best approximation over the temperature range.

The central intermediate value between $x_1$ and $x_0$ is $(x_1+x_0)/2$ and the time period of photographic development $y_2$ necessary at this temperature can be computed from the following formula:

$$Y_2=[(y_1+y_0)/2]-\Delta y$$

and $$\Delta y=[(y_1-y_0)/(x_0-x_1)]\times\alpha$$

where $\alpha$ is an experimentally derived coefficient which may be, for instance, 1.2.

Hence $$y_2 = \frac{y_1 + y_0}{2} - \frac{1.2(y_1 - y_0)}{x_0 - x_1}$$

According to the values $x_2$, $y_2$, $x_0$ and $y_0$ obtained as described above, the values of m and n may be found from Equation (V).

As described above, according to the method of this invention, since proper developing process can be provided over a wide range of the temperature for photographic development, the waiting time until the temperature of the developer reaches the predetermined value is drastically reduced and the use efficiency of the automatic developing device may be substantially enhanced.

In this conjunction, it is intended that the above described embodiment is to be considered in all respects as illustrative and not restrictive, the scope of the invention being indicated by the appended claims rather than by the foregoing description, and all changes which come within the meaning and range of equivalence of the claims therefore are intended to be embraced therein.

What is claimed is:

1. Method for automatically developing photosensitive material, characterized by comprising the steps of:
   - representing a relationship existing between temperature for photographic developer and a time period of photographic development results in regards to a specific developer and the photosensitive material by a mathematical function obtained experimentally;
   - adjusting temperature of the photographic developer to a certain reference temperature; and
   - controlling the time period of photographic development according to the actual temperature of the photographic developer detected by a sensor, said time period being adjusted by changing speed of a conveyor for the photosensitive material in a developing tank; thereby, for time periods when said photographic developer exceeds the reference temperature and even in the course of said photographic developer being heated to attain the reference temperature, the photosensitive material be can processed to obtain acceptable development results.

2. Method according to claim 1, wherein the mathematical function is a polynomial function.

3. Method according to claim 1, wherein the mathematical function is a quadratic function.

4. Method according to claim 1, wherein the mathematical function is a linear function.

5. Method according to claim 1, wherein the mathematical function is an irrational function.

6. Device for automatically developing photosensitive material, comprising:
   - a developing tank having a temperature sensor and a developer heater therein;
   - a computing means which computes a time period of photographic development for obtaining a certain development result in relation with a signal supplied from the temperature sensor according to a certain mathematical function;
   - a means for setting up parameters for the mathematical function of the computing means;
   - a means for controlling the time period of photographic development, said means including a conveyor provided in a developing tank whose conveying speed is variable for the adjustment of the time period of photographic development through adjustment of the time period during which the photosensitive material is in contact with the photographic developer; and
   - a temperature regulating means which activates the heater according to the signal from the temperature sensor so as to regulate the temperature of the developer to a predetermined reference temperature, whereby said photosensitive material can be acceptably processed even during time periods when said developer temperature exceeds the reference temperature and even in the course of said developer being heated to attain the reference temperature, said heater being in an OFF state as long as the temperature of the photographic developer, detected by the temperature sensor, exceeds the reference temperature.

7. An automatic device for continuously developing acceptable photosensitive material, from a start-up mode to a shut-down mode, comprising:
   - a developing tank having a temperature sensor and a developer heater contained therein;
   - a computing means for computing a time period of photographic development for obtaining certain development results in relation with the signal supplied from the temperature sensor according to a certain mathematical function, said mathematical function being dependent upon characteristics of the automatic device and the photosensitive material;
   - a means for setting up parameters for the mathematical function of the computing means;
   - a means for controlling the time period of photographic development, said means including a conveyor provided in the developing tank whose conveying speed is variable for adjustment of the time period of photographic development through adjustment of the time period during which photosensitive material is in contact with photographic development fluids;
   - temperature regulating means which activates the heater according to the signal from the temperature sensors so as to regulate the temperature of the developer to a predetermined reference temperature.

* * * * *